US010096271B2

(12) United States Patent
Zheng

(10) Patent No.: US 10,096,271 B2
(45) Date of Patent: Oct. 9, 2018

(54) LED SCREEN WITH TV APPEARANCE

(71) Applicant: Thinksign optoelectronics llc (hangzhou), Hangzhou, Zhejiang (CN)

(72) Inventor: Zhongliang Zheng, Zhejiang (CN)

(73) Assignee: Thinksign optoelectronics llc (hangzhou), Hangzhou, Zhejiang (CN)

( * ) Notice: Subject to any disclaimer, the term of this patent is extended or adjusted under 35 U.S.C. 154(b) by 333 days.

(21) Appl. No.: 14/880,189

(22) Filed: Oct. 9, 2015

(65) Prior Publication Data

US 2017/0074465 A1 Mar. 16, 2017

(30) Foreign Application Priority Data

Sep. 10, 2015 (CN) ..... 2015 2 0696016 U

(51) Int. Cl.
*G09F 9/33* (2006.01)

(52) U.S. Cl.
CPC ..... *G09F 9/33* (2013.01)

(58) Field of Classification Search
CPC ..... G09F 9/33; G09F 2013/0445; G09F 2013/0427; G09F 13/005
See application file for complete search history.

(56) References Cited

U.S. PATENT DOCUMENTS 5,647,152 A * 7/1997 Miura ..... G09F 9/30 348/E5.131
5,779,351 A * 7/1998 Erickson ..... G09F 9/33 362/240
2005/0210722 A1* 9/2005 Graef ..... G09F 9/30 40/452
2009/0237916 A1* 9/2009 Park ..... G02F 1/133603 362/97.1
2010/0201896 A1* 8/2010 Ostreko ..... B60R 1/12 349/1
2011/0089824 A1* 4/2011 Zheng ..... G09F 9/33 313/512
2011/0090138 A1* 4/2011 Zheng ..... G09F 9/33 345/82
2011/0225859 A1* 9/2011 Safavi ..... G02F 1/133308 40/448
2012/0032891 A1* 2/2012 Parivar ..... G06F 3/04883 345/173
2012/0087118 A1* 4/2012 Bailey ..... F21V 29/507 362/235
2012/0327633 A1* 12/2012 Jang ..... G02F 1/133308 362/97.1

* cited by examiner

*Primary Examiner* — Robert May
*Assistant Examiner* — Leah S Macchiarolo

(57) ABSTRACT

An LED screen includes a back shell, for containing a power source and a master control board, wherein the power source supplies electricity to the master control board; an LED module mounted on the back shell through a first fixer, and connected to the master control board, wherein the LED module comprises a display face, the master control board controls the LED module, so as to display through the display face; a decoration baseboard provided around the LED module and mounted on the back shell through a second fixer, wherein the display face of the LED module is not blocked; and a decoration board mounted on the back shell through a third fixer, wherein the display face of the LED module is not blocked; meanwhile, the decoration board blocks the fixers, in such a manner that the first fixer, the second fixer and third fixer are not externally visible.

10 Claims, 5 Drawing Sheets

LED SCREEN WITH TV APPEARANCE

CROSS REFERENCE OF RELATED APPLICATION

The present invention claims priority under 35 U.S.C. 119(a-d) to CN 201520696016.0, filed Sep. 10, 2015.

BACKGROUND OF THE PRESENT INVENTION

Field of Invention

The present invention relates to an LED screen, particularly to a TV-like LED screen, and more particularly to an LED screen with a TV appearance.

Description of Related Arts

In modern society, with the continuously increasing requirements of life quality and aesthetic, more and more people are becoming aware of the advantages of LED screen, as well as convenience and flexibility thereof during widely utilization. LED screens have been widely used in government squares, leisure squares, bustling commercial centers, commercial streets, highways, airports, stadiums, bus stations, gas stations, chain stores, etc. Small LED screen is also able to be used as home furnishings. The LED screen has been rapidly developed to displace old-fashioned advertising signs or information disseminating tools.

Conventionally used indoor LED screens all have a large volume, and are usually adapt a metal structure. Therefore, both area and weight thereof are relatively large, as well as thickness thereof. For installing such screen, an external steel frame structure is needed, which is very troublesome and poor in movability. In addition, all the commercially available indoor LED screens have problems such as dull appearance, heavy weight, complex installation, poor movability, monotonous display content, and single communication mode. According to the present invention, a mobile LED screen with a TV appearance is developed for overcoming the problems of conventional indoor screens. An appearance thereof likes a TV, which is familiar and popular to people. Such appearance is commonly acceptable. Frame designs thereof are more diversified and novel. Display contents are more varied and colorful. Communication mode is more rapid and convenient, wherein through Bluetooth, WIFI, and USB interfaces, texts, pictures, animation, etc. are able to be inputted by different methods such as phones and computers. Furthermore, the LED screen is able to be moved freely.

SUMMARY OF THE PRESENT INVENTION

An object of the present invention is to overcome the above disadvantages, and provide an LED screen with a TV appearance, which is convenient to be installed, small and exquisite.

Accordingly, in order to accomplish the above object, the present invention provides an LED (Light Emitting Diode) screen, comprising:

a back shell (9), for containing a power source (8) and a master control board (15);

an LED module (5) mounted on the back shell (9) through a first fixer, and connected to the master control board (15), wherein the LED module (5) comprises a display face (20), the master control board (15) controls the LED module (5), so as to display through the display face (20), wherein the power source (8) supplies electricity to the master control board (15) and the LED module (5);

a decoration baseboard (3) provided around the LED module (5) and mounted on the back shell (9) through a second fixer, wherein the display face (20) of the LED module (5) is not blocked by the decoration baseboard (3); and a decoration board (1) mounted on the decoration baseboard (3) through a third fixer, wherein the display face (20) of the LED module (5) is not blocked by the decoration board (1); meanwhile, the decoration board (1) blocks the first fixer, the second fixer and the third fixer, in such a manner that the first fixer, the second fixer and third fixer are not externally visible.

The LED module (5) is mounted on a plurality of module installation boards (6) through a plurality of first tapping screws (4), and the module installation boards (6) are mounted on the back shell (9) through a plurality of module mounting bolts (7).

The decoration baseboard (3) is mounted on the back shell (9) through a plurality of second tapping screws (2).

The LED screen further comprises a button panel (14), which is embedded in the back shell (9), wherein the button panel (14) comprises a plurality of buttons (19) exposed on an external surface (21) of the back shell (9).

The LED screen further comprises a power switch (13) mounted on an external surface (21) of the back shell (9), wherein the power switch (13) controls the power source (8) to supply the electricity to the master control board (15) and the LED module (5).

The LED screen further comprises an indicator light (16) mounted on an external surface (21) of the back shell (9), for displaying a working state of the LED screen.

The LED screen further comprises a wire inlet port (17), in such a manner that an external wire is connected to the power source (8) or the master control board (15), wherein a wire sleeve (12) is provided at the wire inlet port (17), for protecting the external wire.

The LED screen further comprises a plurality of lifting belt bolts mounted on the back shell (9), for connecting a lifting belt.

The LED screen further comprises a nut (11), for mounting the master control board (15) on the back shell (9).

The LED screen further comprises a luminance sensor (18) mounted on the decoration board (1), wherein the luminance sensor (18) is connected to the master control board (15), for sensing an external environment luminance and sending a sensing signal to the master control board (15); the master control board (15) treats the sensing signal for adjusting a display brightness of the LED module (5).

The present invention has advantages as follows.

1) The appearance is well integrated without screws, which is extremely like a TV.

2) A volume is small, and a weight is light, which is about 5 Kg.

3) Operation is in a popular style.

4) Installation is convenient and simple.

5) Communication modes are varied, and is selectable according to personal preference.

6) The design is suitable for different LED modules.

7) The decoration board may be metal or not.

8) The decoration board is able to be personalized according to user requirements.

These and other objectives, features, and advantages of the present invention will become apparent from the following detailed description, the accompanying drawings, and the appended claims.

DETAILED DESCRIPTION OF THE PREFERRED EMBODIMENT

Figure 1:
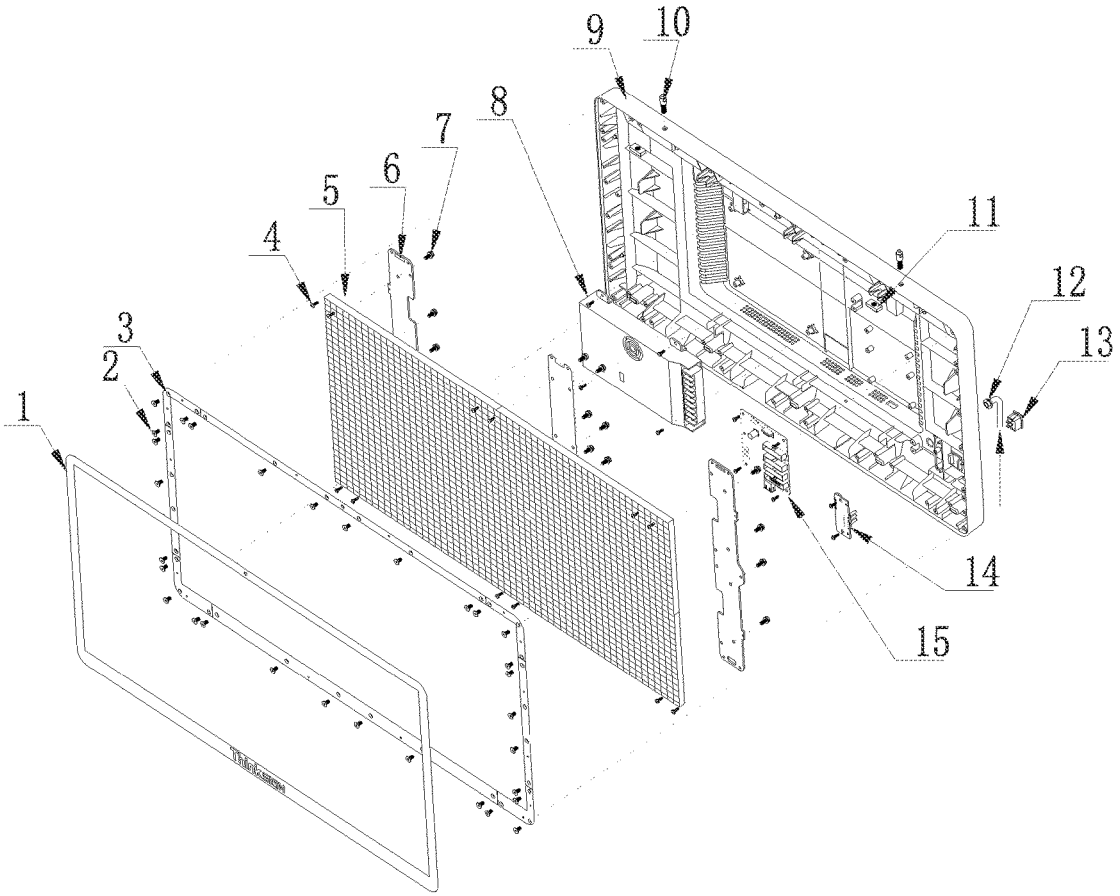
FIG. 1 is an exploded view of an LED screen according to the present invention.
Figure 4:
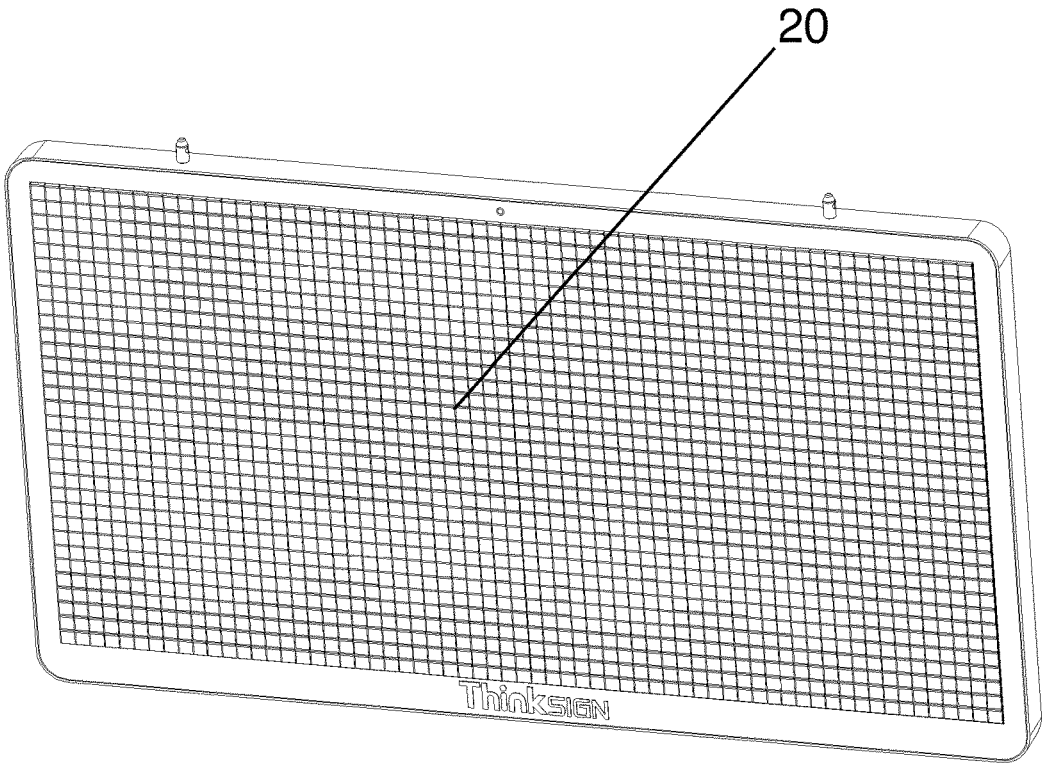
FIG. 4 is a front perspective view of the LED screen according to the present invention.

Referring to FIG. 1 and FIG. 4, an LED screen according to the present invention is provided, comprising:

a back shell 9, for containing a power source 8 and a master control board 15;

an LED module 5 mounted on the back shell 9 through a first fixer, and connected to the master control board 15, wherein the LED module 5 comprises a display face 20, the master control board 15 controls the LED module 5, so as to display through the display face 20, wherein the power source 8 supplies electricity to the master control board 15 and the LED module 5;

a decoration baseboard 3 provided around the LED module 5 and mounted on the back shell 9 through a second fixer, wherein the display face 20 of the LED module 5 is not blocked by the decoration baseboard 3; and a decoration board 1 mounted on the decoration baseboard 3 through a third fixer, wherein the display face 20 of the LED module 5 is not blocked by the decoration board 1; meanwhile, the decoration board 1 blocks the first fixer, the second fixer and the third fixer, in such a manner that the first fixer, the second fixer and third fixer are not externally visible.

Preferably, the LED module 5 is mounted on a plurality of module installation boards 6 through a plurality of first tapping screws 4, and the module installation boards 6 are mounted on the back shell 9 through a plurality of module mounting bolts 7.

Preferably, the decoration baseboard 3 is mounted on the back shell 9 through a plurality of second tapping screws 2.

Figure 2:
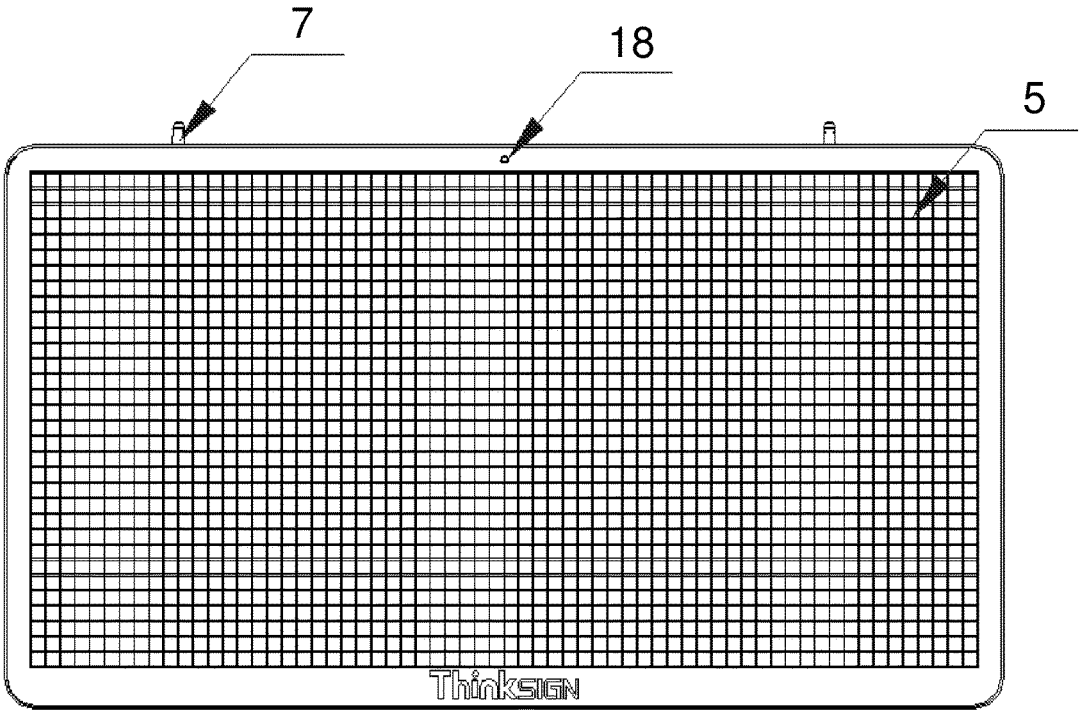
FIG. 2 is a front view of the LED screen according to the present invention.
Figure 5:
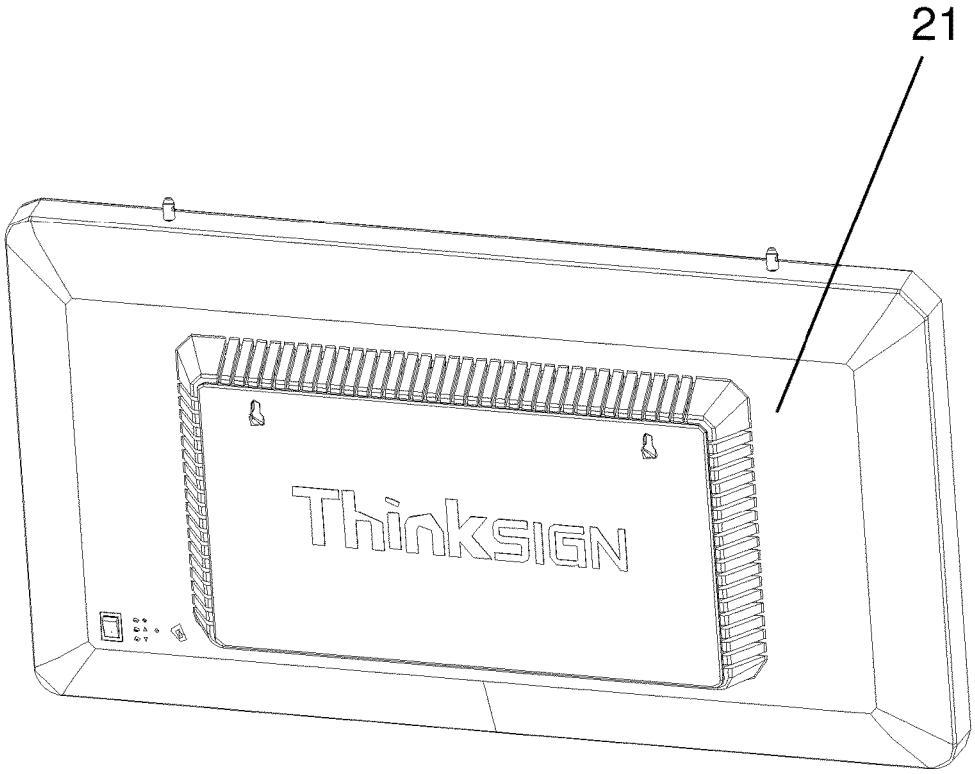
FIG. 5 is a rear perspective view of the LED screen according to the present invention.

Referring to FIG. 2 and FIG. 5, preferably, the LED screen further comprises a button panel 14, which is embedded in the back shell 9, wherein the button panel 14 comprises a plurality of buttons 19 exposed on an external surface 21 of the back shell 9.

Preferably, the LED screen further comprises a power switch 13 mounted on an external surface 21 of the back shell 9, wherein the power switch 13 controls the power source 8 to supply the electricity to the master control board 15 and the LED module 5.

Preferably, the LED screen further comprises an indicator light 16 mounted on an external surface 21 of the back shell 9, for displaying a working state of the LED screen.

Preferably, the LED screen further comprises a wire inlet port 17, in such a manner that an external wire is connected to the power source 8 or the master control board 15, wherein a wire sleeve 12 is provided at the wire inlet port 17, for protecting the external wire.

Preferably, the LED screen further comprises a plurality of lifting belt bolts mounted on the back shell 9, for connecting a lifting belt.

Preferably, the LED screen further comprises a nut 11, for mounting the master control board 15 on the back shell 9.

Figure 3:
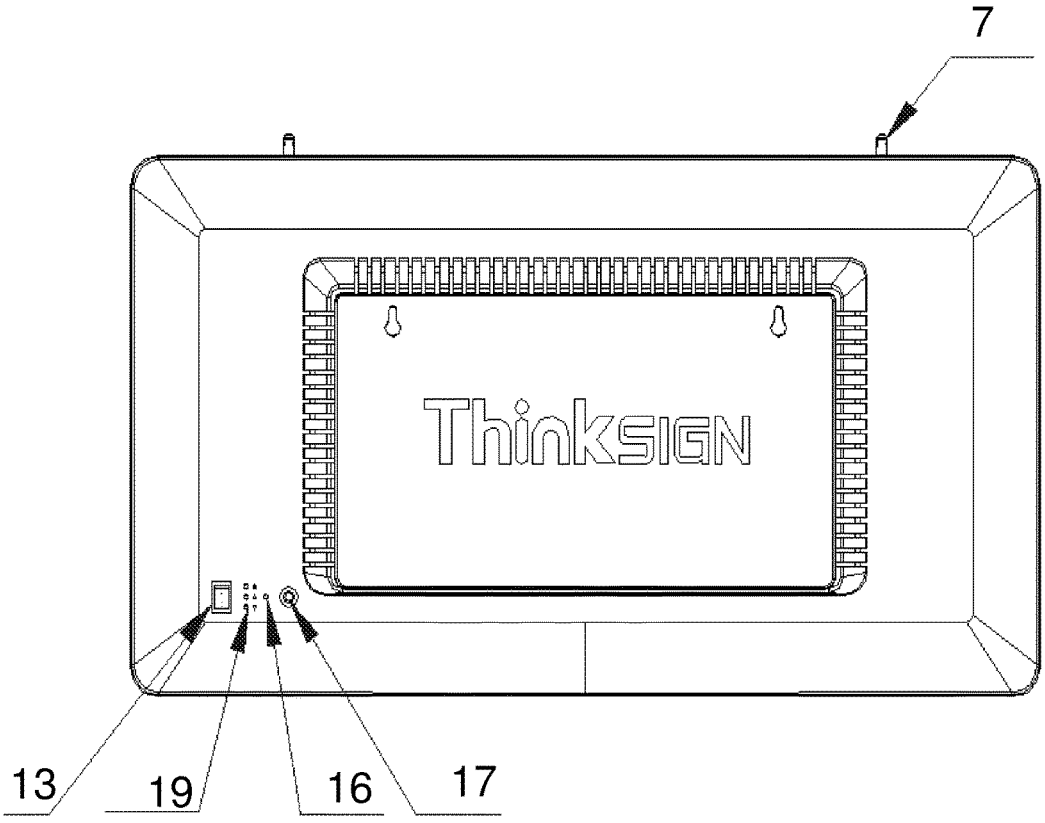
FIG. 3 is a rear view of the LED screen according to the present invention.

Referring to FIG. 3, preferably, the LED screen further comprises a luminance sensor 18 mounted on the decoration board 1, wherein the luminance sensor 18 is connected to the master control board 15, for sensing an external environment luminance and sending a sensing signal to the master control board 15; the master control board 15 treats the sensing signal for adjusting a display brightness of the LED module 5.

According to the present invention, an appearance is integrated, which is neat and dignified without external screw, so as to form a perfect combination. A display module is formed by matrix modules. According to the present invention, assembly of the LED module and connection between the LED module and the shell are simple in structure and easy for manufacturing and installing. The present invention is able to be lifted or hung on a wall due to a light weight, which is only about 5 Kg. A volume is small, in such a manner that the present invention is able to be assembled by a single person. Display content is also able to be conveniently inputted, wherein a USB interface is provided at a bottom portion of a back of the product, while some commonly used buttons are reasonably designed. Operation is humanized, which is simple and easy to be understood. The whole product is designed according to normal operating habits and aesthetic of people.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An LED screen, comprising:

a back shell (9), for containing a power source (8) and a master control board (15);

an LED (Light Emitting Diode) module (5) mounted on the back shell (9) through a first fixer, and connected to the master control board (15), wherein the LED module (5) comprises a display face (20), the master control board (15) controls the LED module (5), so as to display through the display face (20), wherein the power source (8) supplies electricity to the master control board (15) and the LED module (5);

a decoration baseboard (3) provided around the LED module (5) and mounted on the back shell (9) through a second fixer, wherein the display face (20) of the LED module (5) is not blocked by the decoration baseboard (3); and a decoration board (1) mounted on the decoration baseboard (3) through a third fixer, wherein the display face (20) of the LED module (5) is not blocked by the decoration board (1); meanwhile, the decoration board (1) blocks the first fixer, the second fixer and the third fixer, in such a manner that the first fixer, the second fixer and third fixer are not externally visible.

2. The LED screen, as recited in claim 1, wherein the LED module (5) is mounted on a plurality of module installation boards (6) through a plurality of first tapping screws (4), and the module installation boards (6) are mounted on the back shell (9) through a plurality of module mounting bolts (7).

3. The LED screen, as recited in claim 1, wherein the decoration baseboard (3) is mounted on the back shell (9) through a plurality of second tapping screws (2).

4. The LED screen, as recited in claim 1, further comprising a button panel (14), which is embedded in the back shell (9), wherein the button panel (14) comprises a plurality of buttons (19) exposed on an external surface (21) of the back shell (9).

5. The LED screen, as recited in claim 1, further comprising a power switch (13) mounted on an external surface (21) of the back shell (9), wherein the power switch (13) controls the power source (8) to supply the electricity to the master control board (15).

6. The LED screen, as recited in claim 1, further comprising an indicator light (16) mounted on an external surface (21) of the back shell (9), for displaying a working state of the LED screen.

7. The LED screen, as recited in claim 1, further comprising a wire inlet port (17), in such a manner that an external wire is connected to the power source (8) or the master control board (15), wherein a wire sleeve (12) is provided at the wire inlet port (17), for protecting the external wire.

8. The LED screen, as recited in claim 1, further comprising a plurality of belt bolts mounted on the back shell (9), for connecting a belt for lifting the LED screen.

9. The LED screen, as recited in claim 1, further comprising a nut (11) in conjunction with a bolt, for mounting the master control board (15) on the back shell (9).

10. The LED screen, as recited in claim 1, further comprising a luminance sensor (18) mounted on the decoration board (1), wherein the luminance sensor (18) is connected to the master control board (15), for sensing an external environment luminance and sending a sensing signal to the master control board (15); the master control board (15) treats the sensing signal for adjusting a display brightness of the LED module (5).

* * * * *